US007828560B2

(12) United States Patent
Wu et al.

(10) Patent No.: US 7,828,560 B2
(45) Date of Patent: Nov. 9, 2010

(54) CARD EDGE CONNECTOR HAVING AN IMPROVED SPACER

(75) Inventors: Ren-Fu Wu, Kunshan (CN); Wen-Jun Tang, Kunshan (CN); Zhuang-Xing Li, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/535,848

(22) Filed: Aug. 5, 2009

(65) Prior Publication Data

US 2010/0035473 A1 Feb. 11, 2010

(30) Foreign Application Priority Data

Aug. 5, 2008 (CN) ..... 2008 2 0041572

(51) Int. Cl.
*H01R 12/00* (2006.01)

(52) U.S. Cl. ..... 439/79

(58) Field of Classification Search ..... 439/79, 439/701, 540.1, 629, 541.5
See application file for complete search history.

(56) References Cited

U.S. PATENT DOCUMENTS 5,980,272 A * 11/1999 McHugh et al. ..... 439/79
6,551,116 B1 * 4/2003 Liu ..... 439/79
6,884,112 B1 * 4/2005 Juntwait et al. ..... 439/573
6,887,108 B2 * 5/2005 Wu ..... 439/638
6,979,206 B2 12/2005 Bu et al.
7,473,140 B2 1/2009 Guan et al.
7,717,721 B2 * 5/2010 Wu et al. ..... 439/79

* cited by examiner

*Primary Examiner*—Jean F Duverne
(74) *Attorney, Agent, or Firm*—Wei Te Chung; Andrew C. Cheng; Ming Chieh Chang

(57) ABSTRACT

A card edge connector (100) includes an insulative housing (1) having a pair of side walls (10) with a central slot (11) formed therebetween, a set of terminals (5) including first terminals (51) and second terminals (52) and a spacer (3). Each side wall has a set of passageways (12). Each first terminal has a first contacting portion (511) protruding into the central slot, a first tail portion (513) mounted on a PCB, and a first connecting portion (512). The first connecting portions and the first tail portions are arranged in two rows. Each second terminal has a second contacting portion (521) protruding into the central slot, a second tail portion (523) mounted on the PCB, and a second connecting portion (522). The second connecting portions and the second tail portions are arranged in another two rows. The spacer (3) has a set of first protrusions (31) and forms a plurality of first grooves (32) located between each two adjacent first protrusions. The first protrusions each has a second groove (33) formed thereon. The spacer defines a set of second protrusions (34) and forms a plurality of third grooves (35) located between each two adjacent second protrusions (34). The second protrusions each has a fourth groove (36) formed thereon.

13 Claims, 8 Drawing Sheets

CARD EDGE CONNECTOR HAVING AN IMPROVED SPACER

BACKGROUND OF THE INVENTION

1. Field of the Invention

The present invention generally relates to a card edge connector for receiving an memory module and more particularly to a card edge connector having a spacer for retaining terminals.

2. Description of Related Art

With constant development of communications and computer technology, more and more memory modules are being designed to meet various requirements. Card edge connectors are used to connect these memory modules with Printed Circuit Board (PCB). A conventional card edge connector usually comprises an elongated insulative housing, a plurality of terminals coupled thereto, and a base for retaining the terminals. The insulative housing has a central slot for accommodating the memory module. The terminals have contacting portions protruding into the central slot and arranged in two rows, tail portions mounted on the PCB, and connecting portions interconnecting the contacting portions and the tail portions. The base has a plurality of through holes which the tail portions pass through. The connecting portions and the tail portions are arranged in four rows to increase spaces between two adjacent connecting portions or tail portions so as to prevent them from touching with each other.

However, when the terminals are assembled to the base or mounted on the PCB, the connecting portions and the tail portions will be deformed easily. Furthermore, different rows of the connecting portions may touch with each other as a result of the deformations of the terminals.

Hence, an improvement over the prior art is required to overcome the problems thereof.

SUMMARY OF THE INVENTION

According to one aspect of the present invention, a card edge connector for insertion of a memory module comprises an elongated insulative housing having a pair of side walls with a central slot formed therebetween for accommodating the memory module, a plurality of terminals including first terminals and second terminals, and a spacer coupled to the insulative housing. Each side wall defines a plurality of passageways communicating with the central slot. Each first terminal has a first contacting portion received in the passageway and protruding into the central slot, a first tail portion mounted on a PCB, and a first connecting portion interconnecting the first contacting portion and the first tail portion. The first connecting portions and the first tail portions are arranged in two rows. Each second terminal has a second contacting portion received in the passageway and protruding into the central slot, a second tail portion mounted on the PCB, and a second connecting portion interconnecting the second contacting portion and the second tail portion. The second connecting portions and the second tail portions are arranged in another two rows. The spacer defines a plurality of first protrusions at a rear end thereof and forms a plurality of first grooves exposed to exterior and located between each two adjacent first protrusions to receive one row of the first connecting portions. The first protrusions each has a second groove formed thereon and exposed to exterior to receive the other row of the first connecting portions. The spacer defines a plurality of second protrusions at a front end thereof and forms a plurality of third grooves exposed to exterior and located between each two adjacent second protrusions to receive one row of the second connecting portions. The second protrusions each has a fourth groove formed thereon and exposed to exterior to receive the other row of the second connecting portions.

According to another aspect of the present invention, a card edge connector for insertion of a memory module comprises an elongated insulative housing having a pair of upper and lower side walls with a central slot formed therebetween for accommodating the memory module, a plurality of terminals including first terminals and second terminals, a spacer extending into a rear portion of the passageways, and a cover coupled to the insulative housing. Each side wall defines a plurality of passageways communicating with the central slot. Each first terminal has a first contacting portion retained in the upper side wall and protruding downwardly into the central slot, a first tail portion mounted on a PCB, and a first connecting portion interconnecting the first contacting portion and the first tail portion. Each second terminal has a second contacting portion retained in the lower side wall and protruding upwardly into the central slot, a second tail portion mounted on the PCB, and a second connecting portion interconnecting the second contacting portion and the second tail portion. The spacer defines a plurality of grooves at a rear end thereof and exposed to exterior to receive the first connecting portions, and a plurality of grooves at a front end thereof and exposed to exterior to receive the second connecting portions. The spacer resists the second connecting portions in the grooves at the front end thereof. The cover has resisting portions resisting the first connecting portions in the grooves at the rear end of the spacer.

These and additional objects, features, and advantages of the present invention will become apparent after reading the following detailed description of the preferred embodiment of the invention taken in conjunction with the appended drawings.

DETAILED DESCRIPTION OF THE INVENTION

Figure 1:
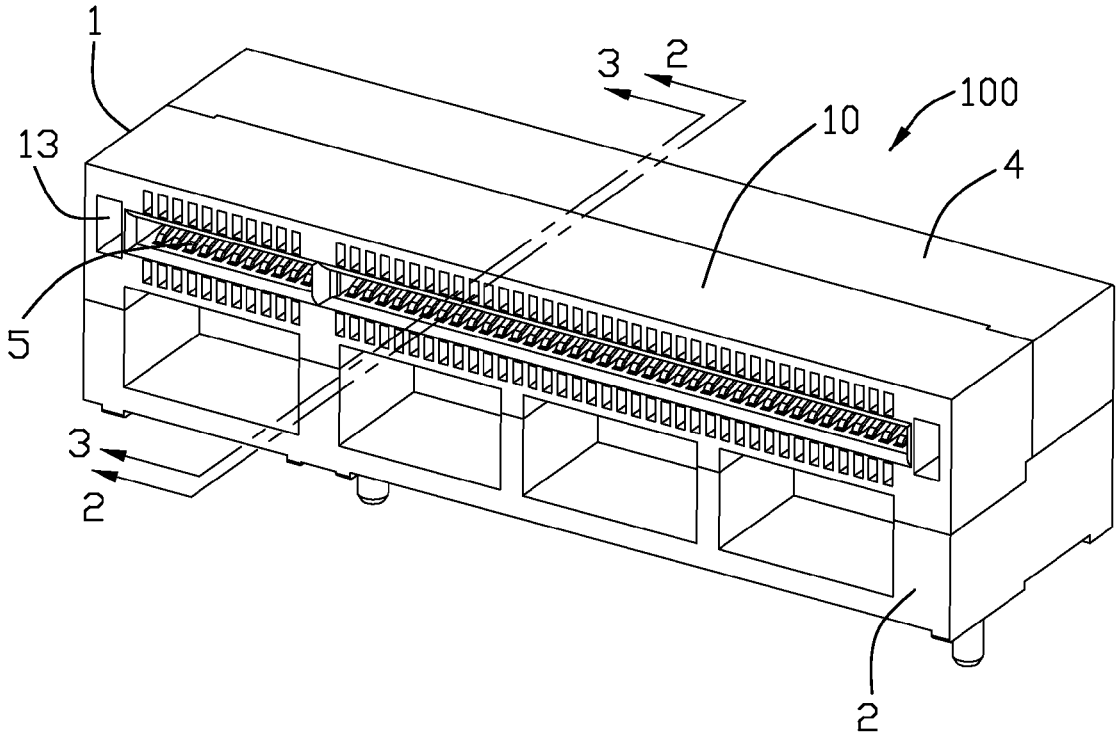
FIG. 1 is a perspective view of a card edge connector according to the present invention.
Figure 2:
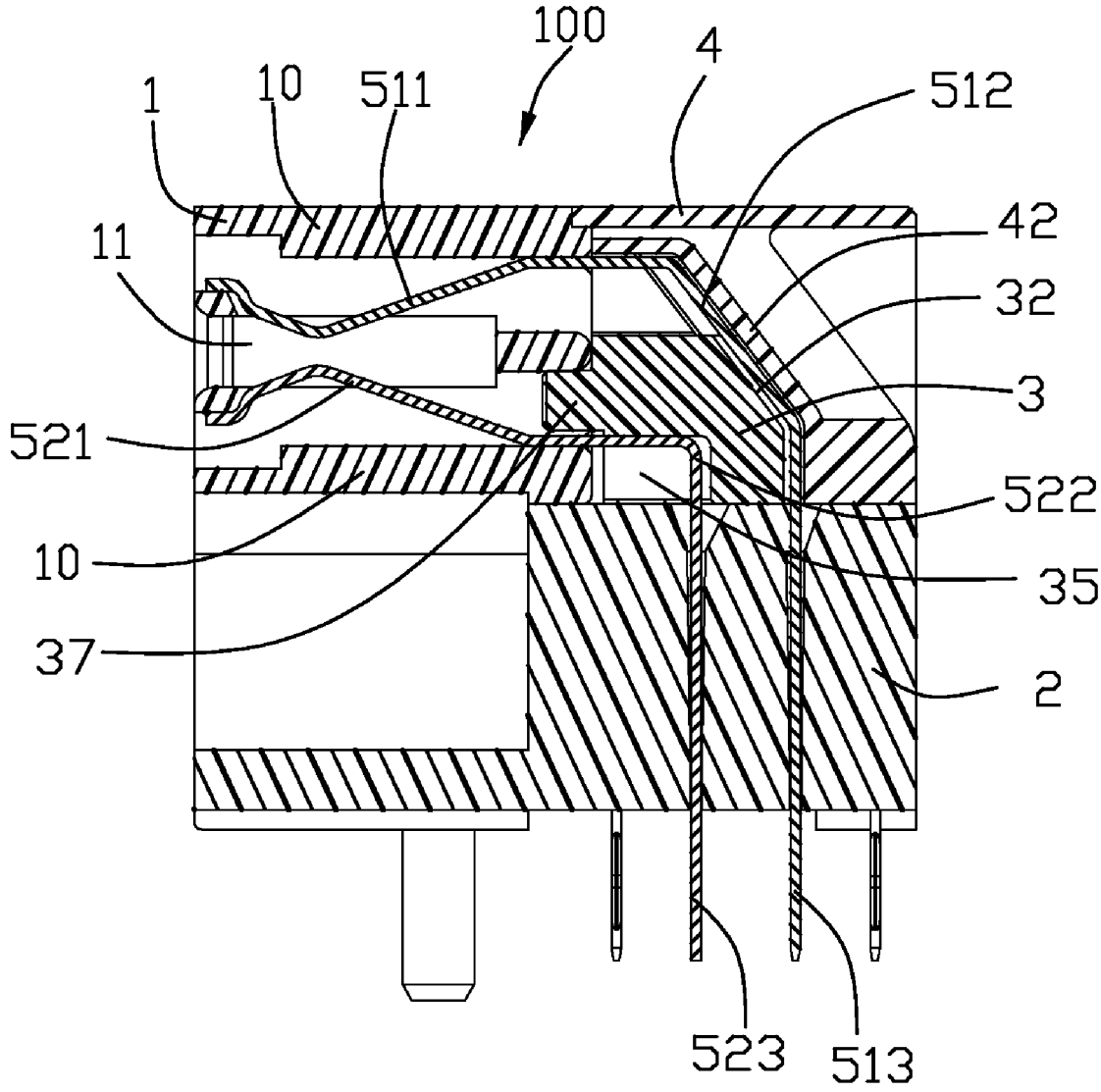
FIG. 2 is a cross-sectional view of the card edge connector taken along line 2-2 shown in FIG. 1.
Figure 3:
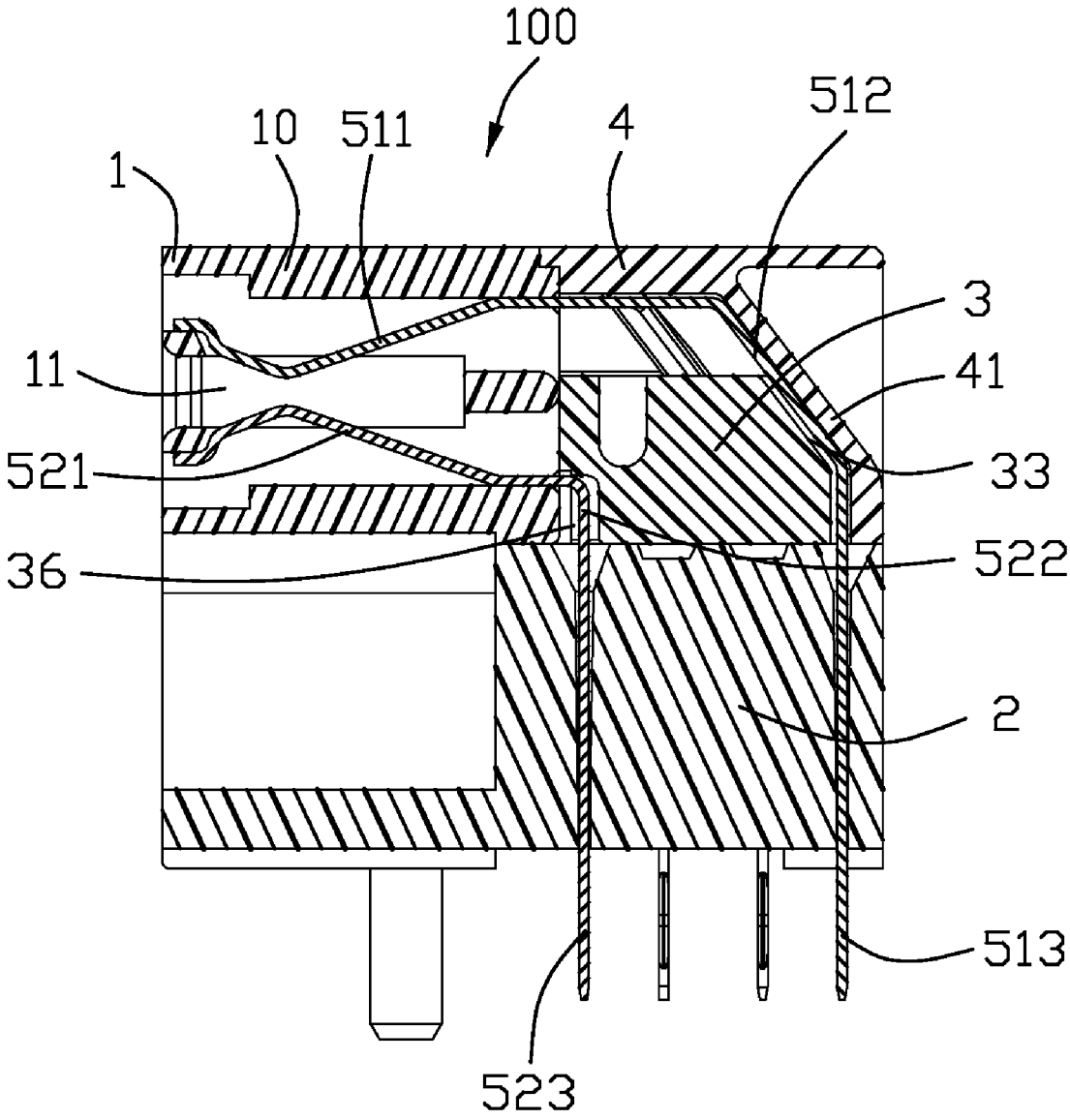
FIG. 3 is a cross-sectional view of the card edge connector taken along line 3-3 shown in FIG. 1.

Reference will now be made to the drawing figures to describe the preferred embodiment of the present invention in detail.

Figure 4:
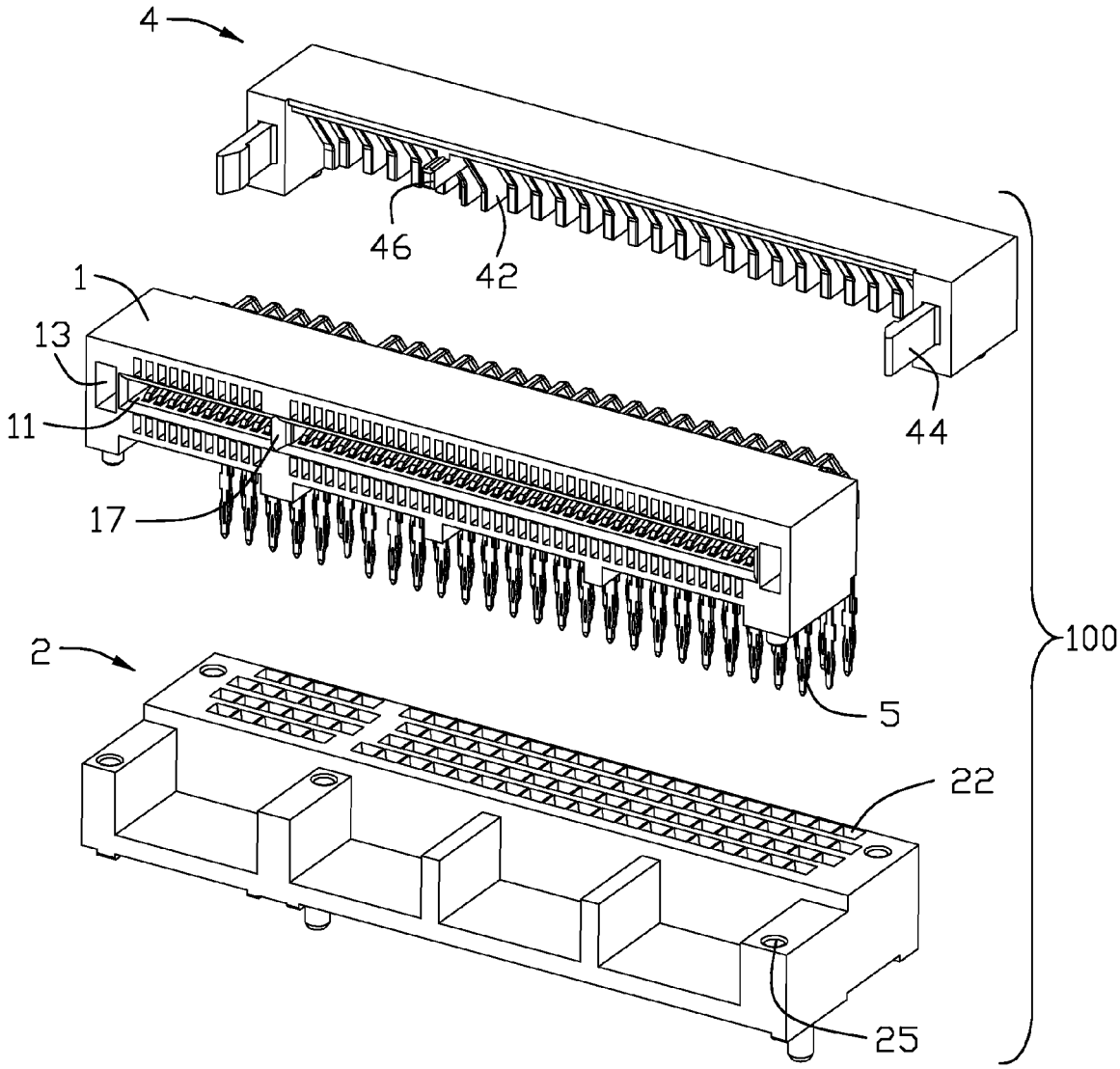
FIG. 4 is a partly exploded view of the card edge connector shown in FIG 1.
Figure 5:
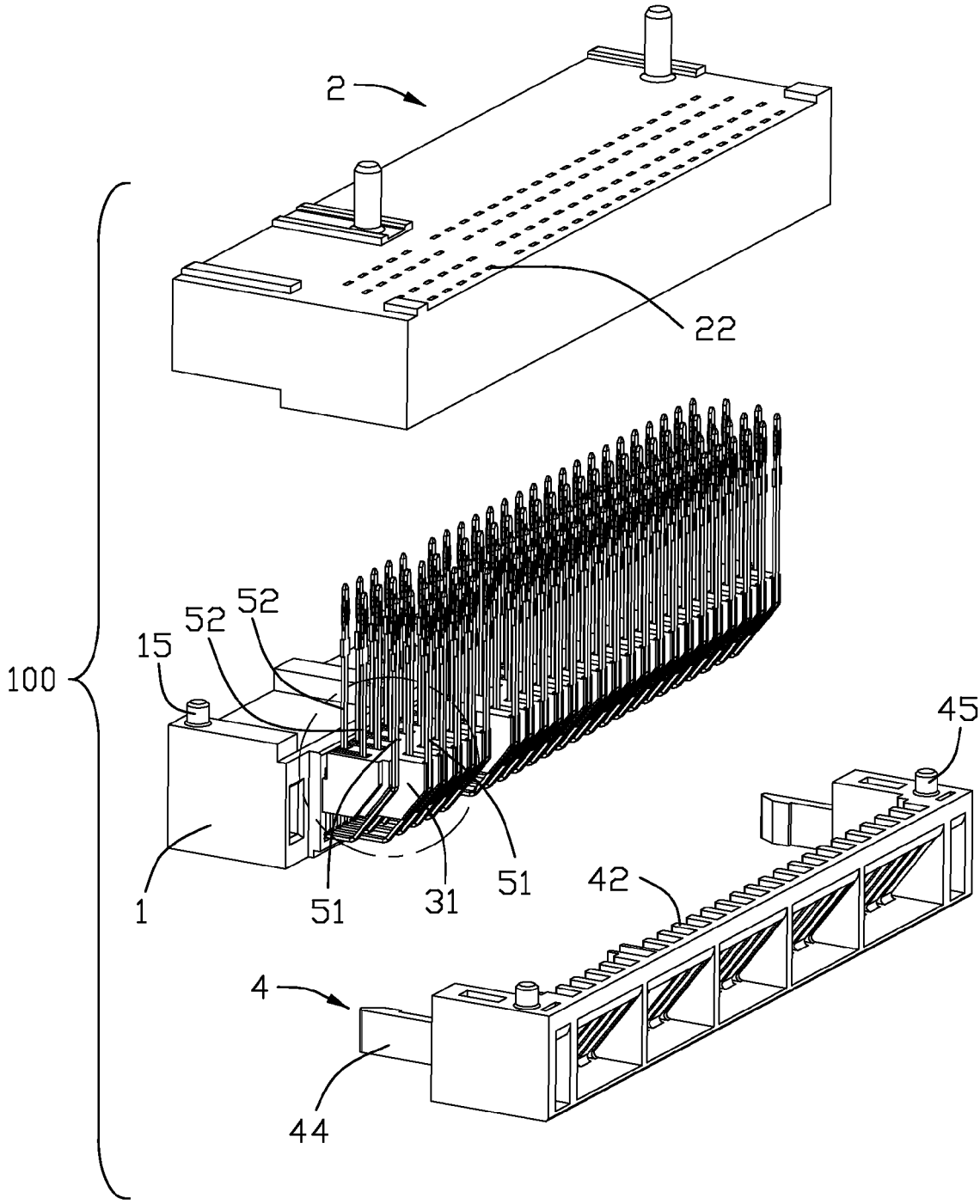
FIG. 5 is an another partly exploded view of the card edge connector shown in FIG. 1.
Figure 6:
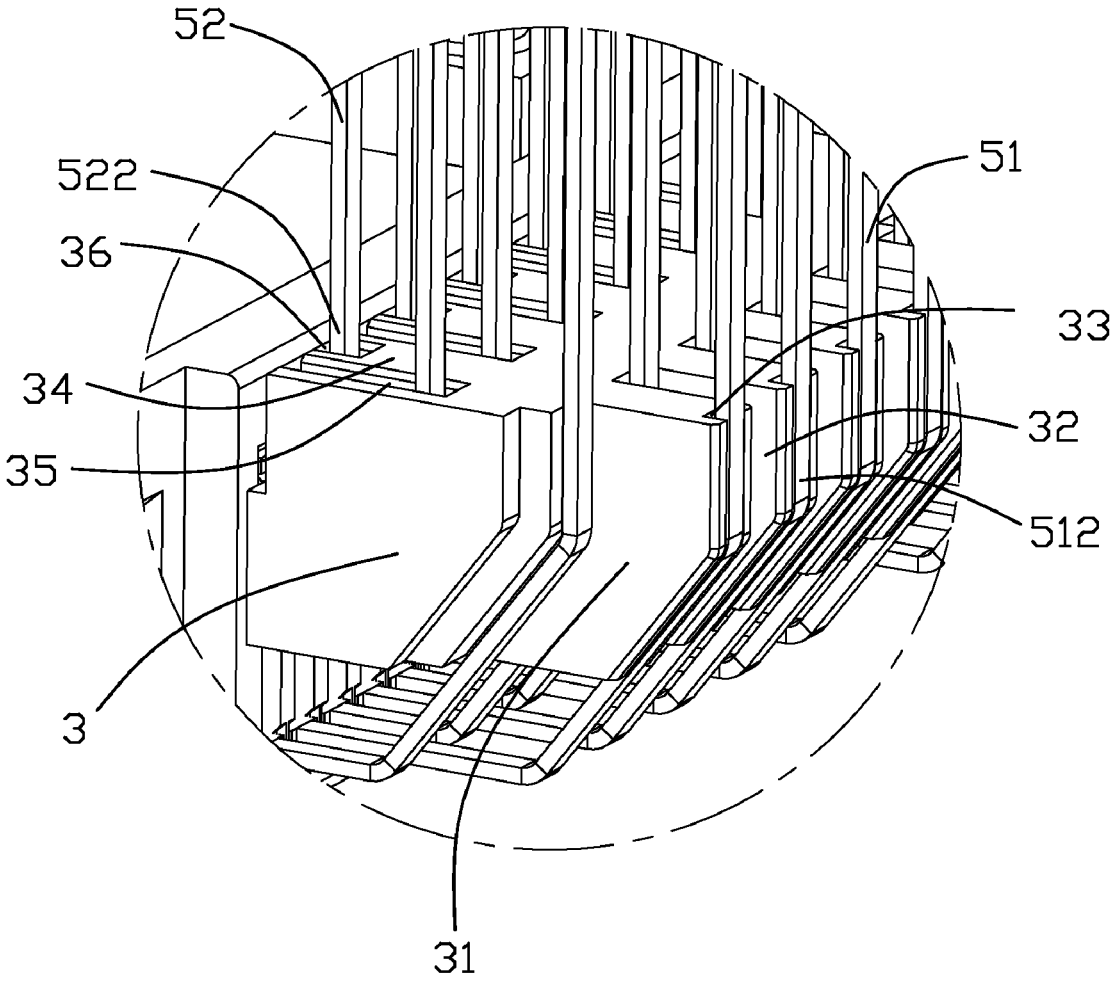
FIG. 6 is a partly enlarged view of a circle portion shown in FIG. 5.

Referring to FIGS. 1, 4 and 5, a card edge connector 100 for insertion of a memory module (not shown) according to the present invention, comprises an elongated insulative housing 1, a plurality of terminals 5 retained in the insulative housing 1, a spacer 3 coupled to the insulative housing 1, a cover 4 covering the spacer 3 and a base 2 located under the insualtive housing 1.

Figure 7:
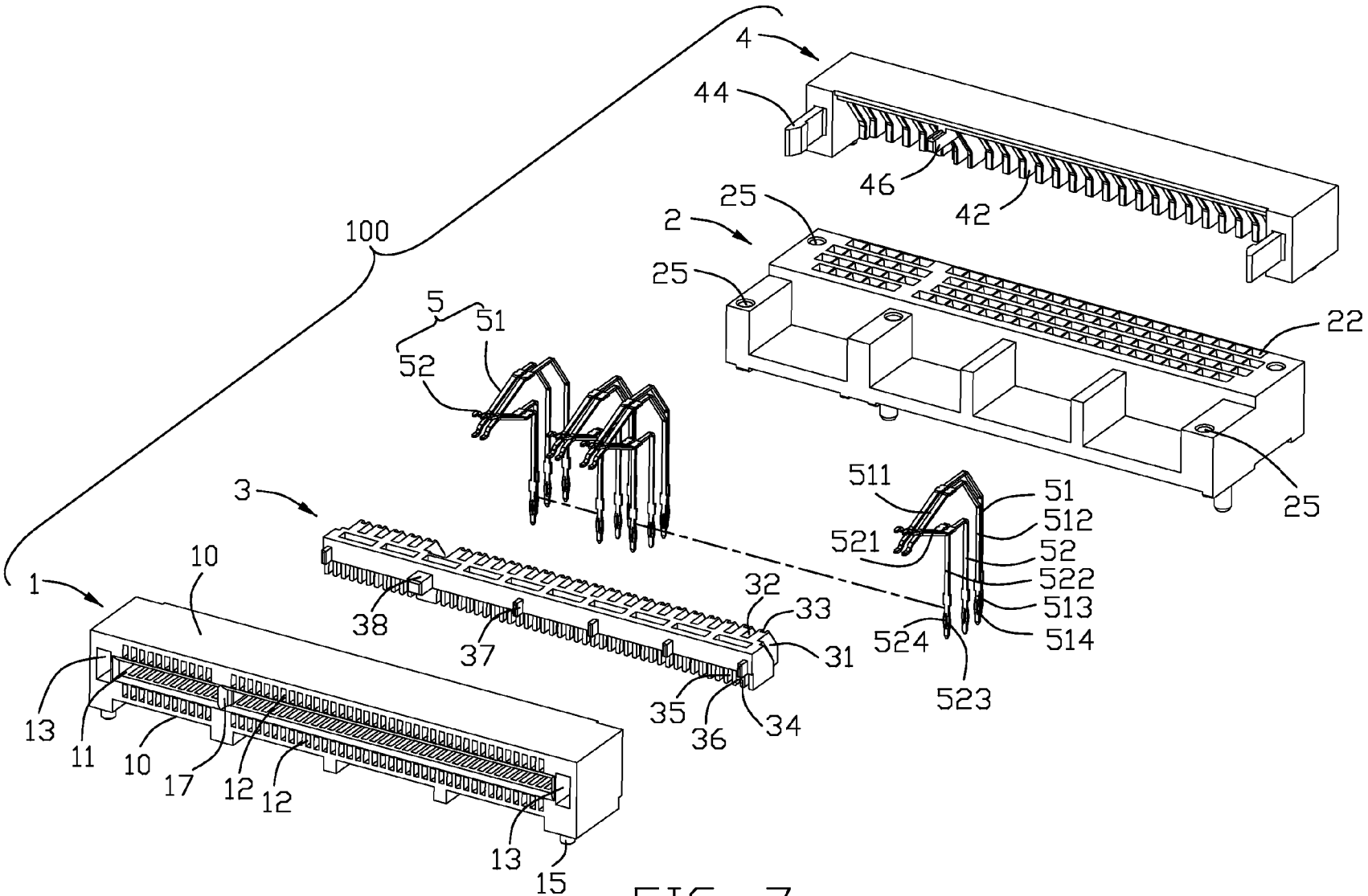
FIG. 7 is an exploded view of the card edge connector shown in FIG. 1.
Figure 8:
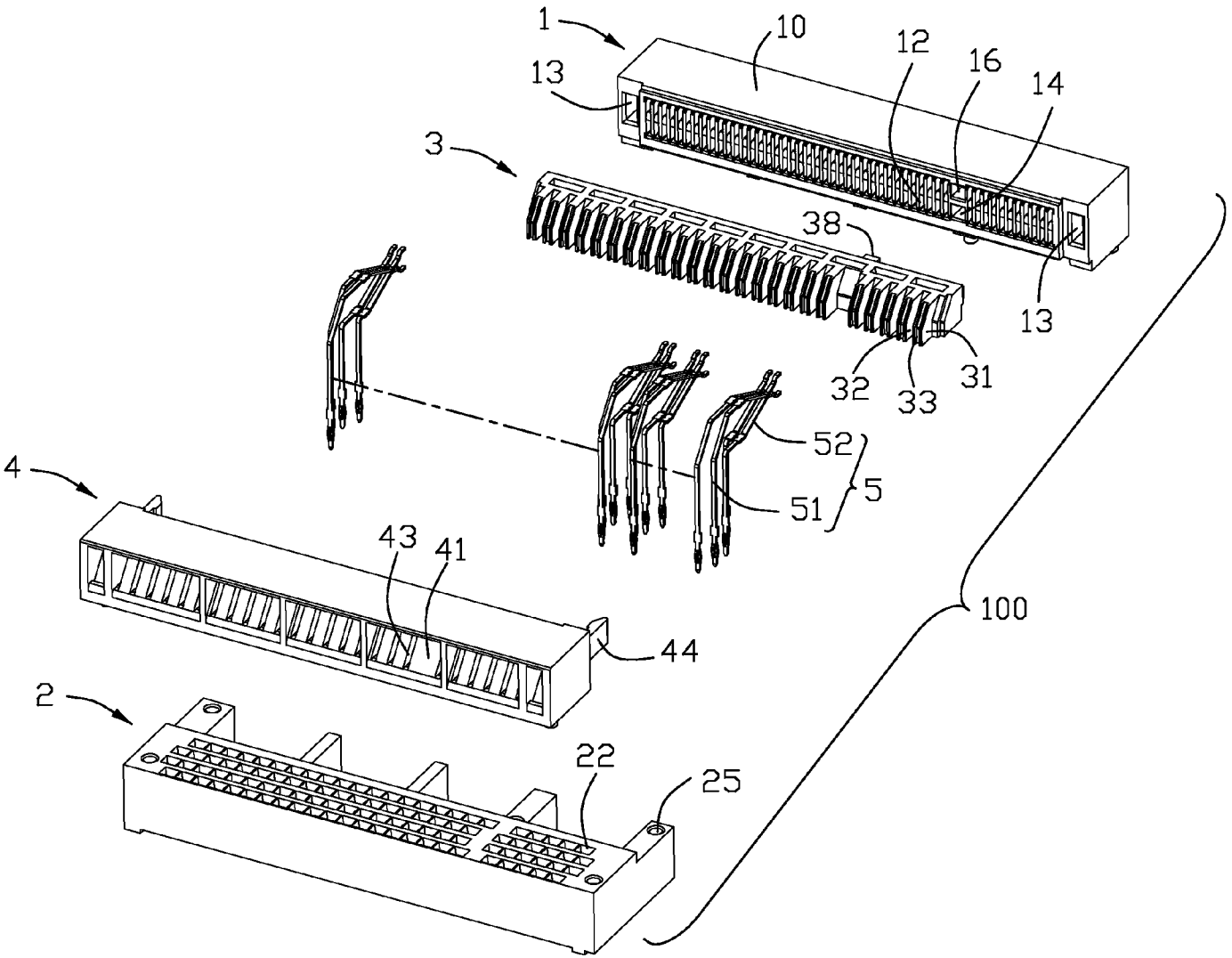
FIG. 8 is an another exploded view of the card edge connector shown in FIG. 1.

Referring to FIGS. 1, 7 and 8, the insulative housing 1 has a pair of upper and lower side walls 10 extending along a lengthwise direction, and an elongated central slot 11 located therebetween for accommodating the memory module. Each side wall 10 has a number of passageways 12 passing therethourgh and communicating with the central slot 11. An embossment 17 is located in the central slot 11 for being received in an notch of the memory module. The insulative housing 1 has a pair of retaining slots 13 formed at two lateral sides of the central slot 11, and a pair of first and second cavities 14, 16 behind the embossment 17 and stacked with each other in a vertical direction. A set of posts 15 extend downwardly from a bottom surface of the insulative housing 1.

The terminals 5 include a number of first terminals 51 and second terminals 52. Each first terminal 51 has a first contacting portion 511 received in the respective passageway 12 of the upper side wall 10 and protruding downwardly into the central slot 11 for electrical connection to the memory module, a first connecting portion 512 extending obliquely downward at a predetermined angle from a rear end of the first contacting portion 511, and a first tail portion 513 extending downwardly from a lower end of the first connecting portion 512. The first contacting portions 511 are arranged in one row along the lengthwise direction of the insulative housing 1. The first connecting portions 512 and the first tail portions 513 are arranged in two rows which are staggered in relation to one another. Each second terminal 52 has a second contacting portion 521 received in the respective passageway 12 of the lower side wall 10 and protruding upwardly into the central slot 11 for electrical connection to the memory module, a second connecting portion 522 extending backwardly and downwardly from a rear end of the second contacting portion 521, and a second tail portion 523 extending downwardly from a lower end of the second connecting portion 522. The second contacting portions 521 are arranged in one row along the lengthwise direction of the insulative housing 1. The second connecting portions 522 and the second tail portions 523 are arranged in two rows which are staggered in relation to one another. The first and second tail portions 513, 523 have slits 514, 524 formed thereon so as to be pressed into a Printed Circuit Board (PCB) without damage to the PCB.

Referring to FIGS. 1-8, the spacer 3 defines a number of first protrusions 31 extending from a rear end thereof, and forms a number of first grooves 32 exposed to exterior and located between each two adjacent first protrusions 31. Each first protrusion 31 forms a second groove 33 shallower than the first groove 32. One row of the first connecting portions 512 are received in the first grooves 32, and the other row of the first connecting portions 512 are received in the second grooves 33, the spacer 3 defines a number of second protrusions 34 formed at a front portion thereof, and forms a number of third grooves 35 exposed to exterior and located between each two adjacent second protrusions 34. Each second protrusion 34 forms a fourth groove 36 shallower than the third groove 35. One row of the second connecting portions 522 are received in the third grooves 35, and the other row of the second connecting portions 522 are received in the fourth grooves 36. Therefore, the spacer 3 is sandwiched between the first connecting portions 512 and the second connecting portions 522. The spacer 3 has a number of locking projections 37 for being retained in the respective passageways 12 and a first block 38 retained in the first cavity 14. Therefore, the spacer 3 could be retained in the insulative housing 1 firmly. Furthermore, the locking projections 37 are retained in the passageways 12, and there is no need to add new slots for receiving the locking projections 37 which will complicate the manufacturing process.

The cover 4 defines a rear wall 41 and a number of resisting projections 42 protruding forwardly from the rear wall 41. The resisting projections 42 protruding into the respective first grooves 32 so as to form first resisting portions to resist one row of the first connecting portions 512 in the first grooves 32. The rear wall 41 forms a second resisting portion to resist the other row of the first connecting portions 512 in the second grooves 32. The spacer 3 resists the second connecting portions 522 downwardly and forwardly in the respective third and fourth grooves 35, 36. Therefore, each first connecting portion 512 could be sandwiched between the spacer 3 and the cover and retained in proper position of the spacer 3 firmly, and each second connecting portion 522 could be sandwiched between the spacer 3 and the insulative housing 1 and retained in proper position of the spacer 3 too. When the first and second tail portions 513, 523 are pressed into the PCB, the first and second connecting portions 512, 522 will not touch with each other as a result of deformation. The cover 4 has a number of openings 43 passing through the rear wall 41 so as to dissipating heat produced from the first contacts 51. The cover 4 has a pair of latching portions 44 at two lateral sides thereof to be latched in the retaining slots 13 and a second block 46 retained in the second cavity 16. Therefore, the cover 4 could be retained in the insulative housing 1 firmly. A set of posts 45 extend downwardly from a bottom surface of the cover 4.

The base 2 is located under the insulative housing 1, the spacer 3 and the cover 4 so as to increase height of the card edge connector 100. The base 2 has a number of perforations 25 to retain the posts 15, 45 of the insulative housing 1 and the cover 4, and a number of through holes 22 for the first tail portions 513 and the second tail portions 523 passing through.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for insertion of a memory module, comprising:

an elongated insulative housing having a pair of side walls with a central slot formed therebetween for accommodating the memory module, each side wall defining a plurality of passageways communicating with the central slot;

a plurality of terminals including first terminals and second terminals, each first terminal having a first contacting portion received in the passageway and protruding into the central slot, a first tail portion to be mounted on a PCB, and a first connecting portion interconnecting the first contacting portion and the first tail portion, the first connecting portions and the first tail portions being arranged in two rows, each second terminal having a second contacting portion received in the passageway and protruding into the central slot, a second tail portion to be mounted on the PCB, and a second connecting portion interconnecting the second contacting portion and the second tail portion, the second connecting portions and the second tail portions being arranged in another two rows; and a spacer coupled to the insulative housing, the spacer defining a plurality of first protrusions at a rear end thereof and forming a plurality of first grooves exposed to exterior and located between each two adjacent first protrusions to receive one row of the first connecting portions, the first protrusions each having a second groove formed thereon and exposed to exterior to receive the other row of the first connecting portions, the spacer defining a plurality of second protrusions at a front end thereof and forming a plurality of third grooves exposed to exterior and located between each two adjacent second protrusions to receive one row of the second connecting portions, the second protrusions each having a fourth groove formed thereon and exposed to exterior to receive the other row of the second connecting portions wherein the card edge connector further comprises a cover having a rear wall resisting one row of the first connecting portions in the second grooves, and a plurality of resisting projections extending from the rear wall and protruding into the first grooves to resist the other row of the first connecting portions in the first grooves, the spacer is sandwiched between the housing and the cover along a front-to-rear direction; wherein the insulative housing has a first cavity, the spacer has a first block extending forwardly therefrom to be retained in the first cavity;

wherein the insulative housing has a second cavity stacked with the first cavity and a pair of retaining slots formed at two lateral sides thereof, the cover has a second block retained in the second cavity and a pair of latching portion latched in the retaining slots.

2. The card edge connector as claimed in claim 1, wherein the second grooves are shallower than the first grooves, and the fourth grooves are shallower than the third grooves.

3. The card edge connector as claimed in claim 1, wherein the spacer has a plurality of locking projections at a front end thereof to be retained in the passageways.

4. The card edge connector as claimed in claim 1, wherein the rear wall has a plurality of openings passing therethrough.

5. The card edge connector as claimed in claim 1, wherein the first connecting portion extending obliquely downwardly at a predetermined angle from a rear end of the first contacting portion, the first tail portion extending downwardly from a lower end of the first connecting portion.

6. The card edge connector as claimed in claim 1, wherein the second connecting portion extending backwardly and downwardly from a rear end of the second contacting portion, the second tail portion extending downwardly from a lower end of the second connecting portion.

7. The card edge connector as claimed in claim 6, wherein the spacer resists the second connecting portions downwardly and forwardly in the respective third and fourth grooves.

8. The card edge connector as claimed in claim 1, wherein the card edge connector further comprising a base located under the insulative housing, the base has a plurality of through holes which the first and second tail portions pass through.

9. The card edge connector as claimed in claim 1, wherein each of the first and second tail portions has a slit formed thereon to be pressed into the PCB.

10. A card edge connector for insertion of a memory module, comprising:

an elongated insulative housing having a pair of upper and lower side walls with a central slot formed therebetween for accommodating the memory module, each side wall defining a plurality of passageways communicating with the central slot;

a plurality of terminals including first terminals and second terminals, each first terminal having a first contacting portion retained in the upper side wall and protruding downwardly into the central slot, a first tail portion mounted on a PCB, and a first connecting portion interconnecting the first contacting portion and the first tail portion, each second terminal having a second contacting portion retained in the lower side wall and protruding upwardly into the central slot, a second tail portion mounted on the PCB, and a second connecting portion interconnecting the second contacting portion and the second tail portion; and a spacer extending into a rear portion of the passageways, the spacer defining a plurality of grooves at a rear end thereof and exposed to exterior to receive the first connecting portions, and a plurality of grooves at a front end thereof and exposed to exterior to receive the second connecting portions, the spacer resisting the second connecting portions in the grooves at the front end thereof; and a cover coupled to the insulative housing and having resisting portions resisting the first connecting portions in the grooves at the rear end of the spacer wherein the first connecting portions are arranged in two rows, the spacer defines a plurality of first protrusions extending at the rear end thereof, the grooves at the rear end of the spacer comprising a plurality of first grooves formed between each two adjacent first protrusions, and a plurality of second grooves formed on the first protrusions and located between each two adjacent first grooves, the cover has a rear wall resisting one row of the first connecting portions in the second grooves and a plurality of resisting projections extending from the rear wall and protruding into the first grooves to resist the other row of the first connecting portions in the first grooves.

11. The card edge connector as claimed in claim 10, wherein the second connecting portions are arranged in two rows at front of the first connecting portions, the spacer defines a plurality of second protrusions at a front and lower end thereof, the grooves at the front end of the spacer comprising a plurality of third grooves formed between each two adjacent second protrusions, and a plurality of fourth grooves formed on the protrusions and located between each two adjacent third grooves.

12. The card edge connector as claimed in claim 10, wherein the card edge connector further comprises a base supporting the insulative housing, the spacer and the cover along a height direction, the first connecting portions are sandwiched between the spacer and the cover, the second connecting portions are sandwiched between the spacer and the insulative housing.

13. An electrical connector comprising:

an insulative main body;

a plurality of contacts disposed in the housing and arranged in upper and lower rows, each of said contacts including a forward front mating section in the housing and a downward rear tail section exposed behind a rear face of the housing;

a middle spacer sandwiched between the upper portions of the tail sections of the upper row and those of the lower row under condition that the upper portions of the tail sections of the lower row are sandwiched between the middle spacer and the rear face of the housing;

an upper spacer cooperating with the middle spacer to sandwich the upper portions of the tail sections of the upper row; and a lower spacer located below all said main body, said middle spacer and said upper spacer wherein said lower spacer defines a plurality of through holes which lower portions of said tail sections of both said upper row and said lower rows extend through; wherein all said main body, said middle spacer and said upper spacer stand on a same upper plane of said lower spacer.

* * * * *